United States Patent [19]

Cronin

[11] Patent Number: 4,879,001

[45] Date of Patent: Nov. 7, 1989

[54] TWIN WIRE FORMER WITH ROLL PRESS FOLLOWED BY EXTENDED NIP PRESS

[75] Inventor: Dennis C. Cronin, Rockton, Ill.

[73] Assignee: Beloit Corporation, Beloit, Wis.

[21] Appl. No.: 245,481

[22] Filed: Sep. 12, 1988

[51] Int. Cl.[4] ..... D21F 9/00; D21F 3/02

[52] U.S. Cl. ..... 162/206; 162/205; 162/300; 162/301; 162/305; 162/306; 162/358; 162/360.1; 162/359

[58] Field of Search ..... 162/203, 205, 206, 300, 162/301, 303, 305, 306, 358, 359, 360.1, 349

[56] References Cited

U.S. PATENT DOCUMENTS

| | | | |
|---|---|---|---|
| 3,268,390 | 8/1966 | Ely, Sr. | 162/360.1 |
| 3,477,905 | 11/1969 | Rogers, Jr. | 162/305 |
| 3,556,940 | 1/1971 | Cronin | 162/358 |
| 4,056,433 | 11/1977 | Koponen et al. | 162/301 |
| 4,219,383 | 8/1980 | Valkama | 162/360.1 |
| 4,483,745 | 11/1984 | Wicks et al. | 162/358 |
| 4,586,984 | 5/1986 | Laapotti | 162/306 |
| 4,662,992 | 5/1987 | Mirsberger | 162/301 |
| 4,704,192 | 11/1987 | Cronin | 162/306 |

*Primary Examiner*—Karen Hastings

*Attorney, Agent, or Firm*—Dirk J. Veneman; Raymond W. Campbell; David J. Archer

[57] ABSTRACT

An apparatus is disclosed for making a paper web from stock. The apparatus includes a first and a second forming wire which cooperate together to define therebetween a web-forming section having a first and a second end. A headbox is disposed adjacent to the first end of the forming section for ejecting the stock between the wires such that the web is formed from the stock during passage of the stock from the first towards the second end of the forming section. A first felt is disposed downstream relative to the forming section with the first felt running contiguously relative to the second wire such that the second wire is disposed between the first felt and the web. A second felt is disposed downstream relative to the forming section and on the opposite side of the web relative to the first felt. An open roll is looped by the first felt and a suction roll is looped by the second felt with the suction roll cooperating with the open roll for defining therebetween a first press nip for pressing a first portion of water from the formed web. A backing roll is disposed downstream relative to the first nip and an extended nip press shoe cooperates with the backing roll for defining therebetween an extended nip such that the second felt and the web extend through the extended nip for removing a second portion of water from the web.

14 Claims, 1 Drawing Sheet

TWIN WIRE FORMER WITH ROLL PRESS FOLLOWED BY EXTENDED NIP PRESS

BACKGROUND OF THE INVENTION

1. FIELD OF THE INVENTION

This invention relates to an apparatus and method for making a paper web from stock. More specifically, this invention relates to a twin-wire former followed by a conventional press followed by an extended nip press.

2. INFORMATION DISCLOSURE STATEMENT

Typically, the forming and pressing sections of a papermaking machine are considered as separate sections and it is necessary to provide a pickup roll adjacent to the couch roll for transferring the formed web from the forming section to the press section.

U.S. Patent No. 3,906,853 to Wohlfarter, issued Sept. 23, 1975, teaches a twin-wire arrangement for removing water from fibrous material including cooperating press rolls 3 and 4 disposed respectively within the loops of the upper and lower wires as shown in FIG. 1 and as described at column 2, lines 53 to 62. However, as shown in FIG. 1 by the arrow attached to roll 4, the roll 4 moves in a vertical direction and therefore generates a squeezing action rather than a high pressure pressing nip required for current paper and board production.

Normally, the formed web passing between the pickup roll and the forming wire does not have a great deal of inherent strength and it has been found that difficulties have been experienced in transferring the newly-formed web from the forming section to the pressure section.

Furthermore, the the ever-increasing demand to decrease the length of the forming and press sections, a need exists to reduce the overall distance between the headbox and the emerging pressed web.

The present invention overcomes both of the aforementioned problems associated with the art of papermaking by having the lower forming wire extend directly through the first press nip.

Therefore, the primary objective of the present invention is to overcome the aforementioned inadequacies of the prior art apparatus and to provide an apparatus which makes a considerable and significant contribution to the papermaking art.

Another object of the present invention is the provision of an apparatus for making a paper web in which the second wire extends through a first press nip.

Another object of the present invention is the provision of a twin-wire former in which a headbox is disposed adjacent to a first end of a forming section defined by a first and a second wire with the second wire supporting the formed web through a first press nip.

Another object of the present invention is the provision of an apparatus for making a paper web in which the second wire extends through a first nip defined by an open roll and a cooperating suction roll.

Another object of the present invention is the provision of an apparatus for making a paper web in which the open roll is looped by a first felt with the first felt running contiguously with the second wire before extending through the first press nip.

Another object of the present invention is the provision of an apparatus for making a paper web in which the pressed web is transferred to and thereafter supported by a second felt which loops the suction roll, the second felt guiding the web through a downstream extended nip press.

Another object of the present invention is the provision of an apparatus for making a paper web in which the web is heated by steam downstream relative to the first press nip and before passage of the pressed web through the extended nip.

Other objects and advantages of the present invention will be apparent to those skilled in the art by a consideration of the detailed description contained hereinafter taken in conjunction with the annexed drawings.

SUMMARY OF THE INVENTION

The present invention relates to an apparatus and method for making a paper web from stock. The apparatus includes a first and a second forming wire which cooperate together to define therebetween a web-forming section having a first and a second end. A headbox is disposed adjacent to the first end of the forming section for ejecting the stock between the wires such that the web is formed from the stock during passage of the stock from the first towards the second end of the forming section. A first felt is disposed downstream relative to the forming section and the first felt runs contiguously relative to the second wire such that the second wire is disposed between the first felt and the web. A second felt is disposed downstream relative to the forming section and on the opposite side of the web relative to the first felt. An open roll is looped by the first felt and a suction roll is looped by the second felt. The open roll and suction roll cooperate to define therebetween a first press nip for pressing a first portion of water from the formed web. A backing roll is disposed downstream relative to the first press nip and an extended nip press shoe cooperates with the backing roll for defining therebetween an extending nip such that the second felt and the web extend through the extended nip for removing a second portion of water from the web.

In a specific embodiment of the present invention, the web forming section is disposed substantially horizontally and the headbox is oriented relative to the first end of the web-forming section such that the stock ejected from the headbox contacts the second wire before extending through the web-forming section.

The first felt runs contiguously relative to the second wire upstream relative to the first press nip and the second felt converges towards the second wire before extending through the first press nip.

The open roll is disposed below the suction roll and the backing roll is a grooved roll. Furthermore, the term "open roll" includes a VENTANIP roll. VENTANIP is a common law trademark of Beloit Corporation.

In a first embodiment of the present invention, the backing roll is looped by the second felt such that the second felt is disposed between the web and the backing roll.

In a second embodiment of the present invention, the shoe is looped by the second felt such that the second felt is disposed between the web and the shoe.

In both embodiments of the present invention, the apparatus also includes a third felt which extends through the extended nip such that the web is disposed between the second and third felt.

Additionally, the apparatus includes a steam box which is disposed on one side of the web between the first nip and the extended nip and a vacuum box is disposed adjacent to the steam box with the vacuum box being on the opposite side of the web relative to the steam box for heating the web prior to passage of the web through the extended nip.

The method for making a web of paper from stock includes the steps of:

Ejecting the stock from a headbox between a first and a second forming wire defining therebetween a forming section having a first and a second end.

Guiding the formed web supported by the lower wire through a first press nip defined by an open roll and a cooperating suction roll.

Transferring the pressed web to a second felt which extends through the first press nip.

Steam heating the supported, pressed web downstream relative to the first press nip.

Guiding the heated web through the extended nip for removing a second portion of water from the web.

Although specific embodiments of the present invention are disclosed and described hereinafter, it is to be understood that many modifications and variations of the present invention can be made by those skilled in the art and that these variations fall within the spirit and scope of the present invention as defined by the appended claims.

Included among such modifications would be the provision of a grooved, or otherwise vented, blanket for the extended nip press and the use of a fine mesh lower wire in order to reduce the surface marking of the web during passage through the first press nip.

Although the specific embodiments of the present invention teach a twin-wire former with a headbox disposed adjacent to the first end of the forming section, it will be apparent to those skilled in the art that the present invention is equally applicable to a conventional forming section including a fourdrinier wire and a headbox for ejecting stock onto the fourdrinier wire with the wire subsequently extending through the first nip.

Although the present invention relates to the production of a paper web from stock, it will be understood by those skilled in the art that the present invention has particular application to the production of linerboard and the like.

BRIEF DESCRIPTION OF THE DRAWINGS

Similar reference characters refer to similar parts throughout the various embodiments of the present invention.

DETAILED DESCRIPTION OF THE DRAWINGS

Figure 1:
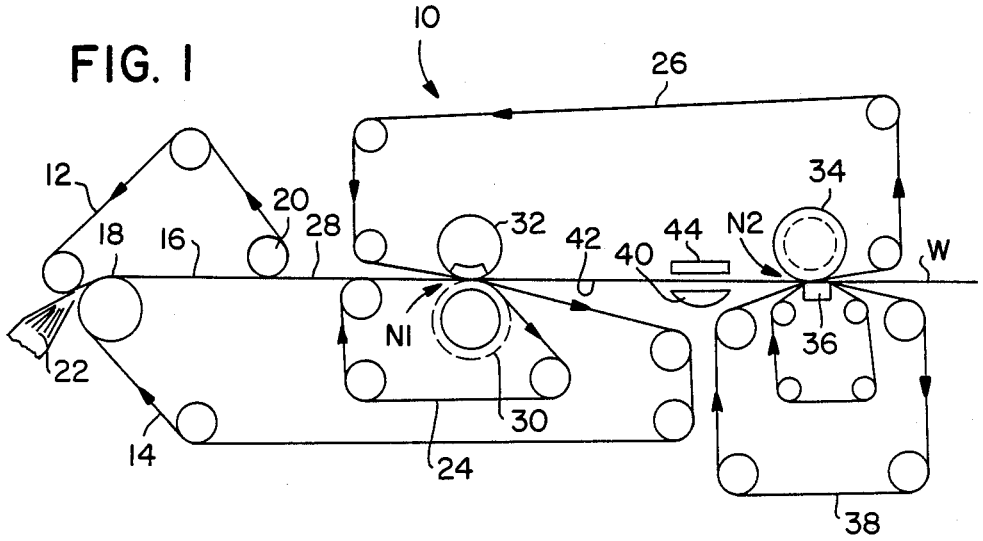
FIG. 1 is a side-elevational view showing the combined forming section and press section according to the present invention.

FIG. 1 shows an apparatus generally designated 10 for making a paper web W from stock. The apparatus 10 includes a first and second forming wire 12 and 14 respectively which cooperate together to define therebetween a web-forming section 16 having a first and a second end 18 and 20 respectively. A headbox 22 is disposed adjacent to the first end 18 of the forming section 16 for ejecting stock between the wires 12 and 14 such that the web W is formed from the stock during passage of the stock from the first toward the second end 18 and 20 respectively of the forming section 16. A first felt 24 is disposed downstream relative to the forming section 16 with the first felt 24 running contiguously relative to the second wire 14 such that the second wire 14 is disposed between the first felt 24 and the web W. A second felt 26 is disposed downstream relative to the forming section 16 and on the opposite side 28 of the web W relative to the first felt 24. An open roll 30 such as a VENTANIP roll is looped by the first felt 24 and a suction roll 32 is looped by the second felt 26 and cooperates with the open roll 30 for defining therebetween a first press nip N1 for pressing a first portion of water from the formed web W. A backing roll 34 is disposed downstream relative to the first nip N1 and an extended nip press shoe 36 cooperates with the backing roll 34 for defining therebetween an extended nip N2 such that the second felt 26 and the web W extend through the extended nip N2 for removing a second portion of water from the web W.

As shown in FIG. 1, the web-forming section 16 is disposed substantially horizontally and the headbox 22 is oriented relative to the first end 18 of the web-forming section 16 such that the stock ejected from the headbox 22 contacts the second wire 14 before extending through the web-forming section 16.

FIG. 1 shows the first felt 24 running contiguously relative to the second wire 14 upstream relative to the first press nip N1. Also, the second felt 26 converges towards the web and second wire 14 before extending through the first press nip N1.

The open roll 30 is disposed below the suction roll 32 and the backing roll 34 is a vented roll. More specifically, as shown in FIG. 1, the backing roll 34 is grooved and is looped by the second felt 26 such that the second felt 26 is disposed between the web W and the backing roll 34.

In the embodiment shown in FIG. 1, the apparatus 10 also includes a third felt 38 which extends through the extended nip N2 such that the third felt 38 is disposed between the shoe 36 and the web W.

Figure 2:
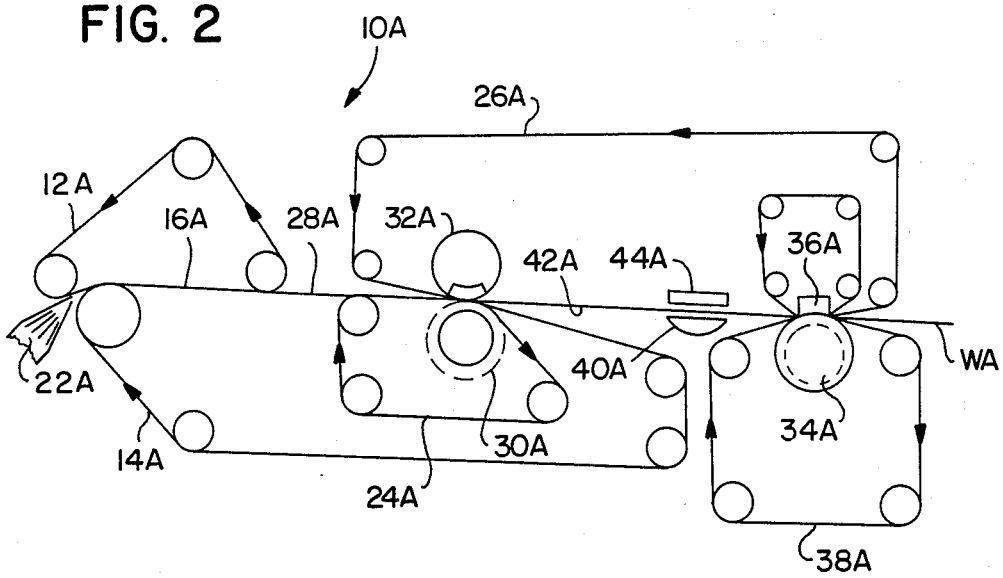
FIG. 2 is a side-elevational view of an alternative embodiment of the present invention showing the shoe disposed above the backing roll.

In an alternate embodiment of the present invention as shown in FIG. 2, the apparatus 10A is disposed such that the shoe 36A is looped by the second felt 26A such that the second felt 26A is disposed between the web WA and the shoe 36A.

The third felt 38A of FIG. 2 loops around the backing roll 34A.

Also, in both embodiments, the apparatus includes a steam box 40 and 40A respectively disposed on one side 42 and 42A respectively of the web between the first nip and the extended nip. A vacuum box 44 and 44A respectively is disposed adjacent to the steam box 40,40A with the vacuum box being disposed on the opposite side 28,28A of the web relative to the steam box for heating the web prior to passage of the web through the extended nip.

As shown in FIGS. 1 and 2, the second felt 26,26A is disposed between the vacuum box and the web.

In operation of the apparatus as shown in both FIGS. 1 and 2, stock is ejected from the headbox 22,22A such that the stock extends through the forming section 16,16A defined by the first and second wires 12,12A and 14,14A respectively. The formed web supported by the lower wire 14.14A extends through a first press nip defined by the open roll and suction roll. The first felt 24,24A loops around the open roll and the web is disposed between the second wire and a second felt which is looped around the suction roll. The pressed web is transferred to the second felt 26,26A and is guided thereby past the steam box which heats the web prior to the web extending through the extending nip.

The present invention overcomes all of the problems associated with transferring a newly-formed web from a forming wire to a press section and also provides a combined forming a press section of compact configuration.

What is claimed is:

1. A apparatus for making a paper web from stock, said apparatus having a direction of web travel and comprising:

first and second forming wire loops cooperating together to define therebetween a substantially horizontal web forming section having a first and a second end;

a headbox disposed adjacent to said first end of said forming section for ejecting the stock between said wires such that the web is formed in the direction of web travel from the stock during passage of the stock from said first towards said second end of said forming section;

a first felt disposed downstream in the direction of web travel relative to said forming section, said first felt running contiguously relative to said second wire in the second wire loop such that said second wire is disposed between said first felt and the web;

a second felt disposed downstream in the direction of web travel relative to said forming section and on the opposite side of the web relative to said first felt;

an open roll looped by said first felt;

a suction roll looped by said second felt and cooperating with said open roll for defining therebetween a first press nip for pressing a first portion of water from the formed web;

a backing roll disposed downstream in the direction of web travel relative to said first nip; and an extended nip press shoe cooperating with said backing roll for defining therebetween an extended nip such that said second felt and the web extend through said extended nip for removing a second portion of water from the web.

2. An apparatus as set forth in claim 1 wherein said headbox is oriented relative to said first end of said web-forming section such that the stock ejected from said headbox contacts said second wire before extending through said web-forming section.

3. An apparatus as set forth in claim 1 wherein said first felt runs contiguously relative to said second wire upstream in the direction of web travel relative to said first press nip.

4. An apparatus as set forth in claim 1 wherein said second felt converges towards said second wire before extending through said first press nip.

5. An apparatus as set forth in claim 1 wherein said open roll is disposed below said suction roll.

6. An apparatus as set forth in claim 1 wherein said backing roll is a vented roll.

7. An apparatus as set forth in claim 6 wherein said backing roll is a grooved roll.

8. An apparatus as set forth in claim 1 wherein said backing roll is looped by said second felt such that said second felt is disposed between the web and said backing roll.

9. An apparatus as set forth in claim 1 wherein said shoe is looped by said felt such that said second felt is disposed between the web and said shoe.

10. An apparatus as set forth in claim 1 further including:

a third felt extending through said extended nip such that said third felt is disposed between said shoe and the web.

11. An apparatus as set forth in claim further including:

a steam box disposed on one side of the web between said first nip and said extended nip;

a vacuum box disposed adjacent to said steam box, said vacuum box being disposed on the opposite side of the web relative to said steam box for heating the web prior to passage of the web through said extended nip.

12. An apparatus as set forth in claim 11 wherein said second felt is disposed between said vacuum box and the web.

13. An apparatus for making a paper web from stock, said apparatus having a direction of web travel comprising:

first and second forming wire loops cooperating together to define therebetween a substantially horizontal web forming section having a first and a second end;

a headbox disposed adjacent to said first end of said forming section for ejecting the stock between said wires such that the web is formed in the direction of web travel from the stock during passage of the stock from said first towards said second end of said forming section;

a first felt disposed in the direction of web travel relative to said forming section, said first felt running contiguously relative to said second wire in the second wire loop such that said second wire is disposed between said first felt and the web;

a second felt disposed downstream in the direction of web travel relative to said forming section and on the opposite side of the web relative to said first felt;

an open roll looped by said first felt;

a suction roll looped by said second felt and cooperating with said open roll for defining therebetween a first press nip for pressing a first portion of water from the formed web;

a backing roll looped by said second felt and disposed downstream in the direction of web travel relative to said first nip;

an extended nip press shoe cooperating with said backing roll for defining therebetween an extended nip such that said second felt and the web extend through said extended nip for removing a second portion of water from the web, said second felt being disclosed between the web and said backing roll;

a steam box disposed on one side of the web between said first nip and said extended nip; and a vacuum box disposed adjacent to said stem box, said vacuum box being on the opposite side of the web relative to said steam box for heating the web prior to passage of the web through said extended nip.

14. A method for making a paper web from stock, said method comprising the steps of:

ejecting the stock from a headbox between a first and a second forming wire which cooperate together to define therebetween a substantially horizontal web forming section having a first and a second end;

forming the web during passage of the stock from the first to the second end of the forming section;

supporting the formed web on the second wire and guiding the formed web on the second wire through a first press nip defined by an open roll and a cooperating suction roll, the first press nip being disposed downstream relative to the forming section;

guiding a first felt disposed downstream relative to the forming section through said first press nip, the first felt running contiguously relative to the second wire such that the second wire is disposed between the first felt and the web and such that said first felt loops the open roll;

transferring the pressed web to a second felt which extends through the first press nip and which loops around the suction roll;

applying steam to the press web downstream relative to the first press nip for heating the web; and further pressing the pressed web by guiding the pressed, heated web and said second felt through an extended nip press.

* * * * *